US006543465B2

(12) United States Patent
Choi

(10) Patent No.: US 6,543,465 B2
(45) Date of Patent: Apr. 8, 2003

(54) FOLDABLE BOARD FOR ARRANGING SMALL ARTICLES IN A TENT

(76) Inventor: Kyong-Jai Choi, Room 312-301 Samik Beach Apt. 148, Namchun-dong Sooyoung-ku, Busan (KR)

( * ) Notice: Subject to any disclaimer, the term of this patent is extended or adjusted under 35 U.S.C. 154(b) by 0 days.

(21) Appl. No.: 09/854,506

(22) Filed: May 15, 2001

(65) Prior Publication Data

US 2002/0104841 A1 Aug. 8, 2002

(30) Foreign Application Priority Data

Feb. 2, 2001 (KR) ..... 01-2459

(51) Int. Cl.[7] ..... E04H 15/32
(52) U.S. Cl. ..... 135/120.1; 135/121; 248/309.1
(58) Field of Search ..... 248/309.1, 311.2, 248/205.2; 135/124, 121, 136, 137, 115

(56) References Cited

U.S. PATENT DOCUMENTS

| | | | | | |
|---|---|---|---|---|---|
| 4,858,796 | A | * | 8/1989 | Roth | 248/205.2 |
| 5,042,770 | A | * | 8/1991 | Louthan | 248/311.2 |
| 5,246,151 | A | * | 9/1993 | Jabara | 224/42.42 |
| 5,526,970 | A | * | 6/1996 | Yates | 224/270 |
| 5,558,026 | A | * | 9/1996 | Seibert | 108/44 |
| 6,168,061 | B1 | * | 1/2001 | Harrison | 224/666 |
| D442,038 | S | * | 5/2001 | Goldborough | 248/309.1 |

FOREIGN PATENT DOCUMENTS

| | | | | |
|---|---|---|---|---|
| FR | 2614351 | * | 4/1987 | E04H/15/00 |
| JP | 5-171838 | * | 7/1993 | E04H/15/44 |

* cited by examiner

*Primary Examiner*—Jose V. Chen
*Assistant Examiner*—Chi Q. Nguyen
(74) *Attorney, Agent, or Firm*—Jacobson Holman PLLC

(57) ABSTRACT

A foldable board for use in a tent, addressing the inconvenience of conventional tents by providing a secure resting surface inside the tent. With conventional tents, it is troublesome to keep cups or opened beverage cans in the tent, because the ground is rough and bumpy, with considerable risk that the drink or other item will be upset or fall down on the ground, thereby soiling the tent or clothes and creating discomfort. So, cups and drink cans have to be supported between some props or held by a person. In order to address these inconveniences, a foldable board is provided, the back side of which is attached to the inside of a tent, the sides of which are also provided with props for securing goods, and the bottom of which is PVC laminated and sewn with bias. The bottom can be folded up and pulled down with hook and loop closures attached to the back prop and to a corresponding spot on the PVC laminated bottom prop. The prop is further provided with a mesh bag for holding an opened drink can or a cup securely and safely, and such belongings as cigarette pack can be placed on the rest space of the PVC bottom prop, thus maximizing practicality and minimizing inconvenience when camping.

17 Claims, 3 Drawing Sheets

FOLDABLE BOARD FOR ARRANGING SMALL ARTICLES IN A TENT

FIELD OF THE INVENTION

The present invention relates to a foldable board for use in a tent and, more particularly, to a foldable board for keeping some small personal belongings and an opened beverage can conveniently.

DESCRIPTION OF THE PRIOR ART

With conventional tents, it is troublesome to keep cups or opened beverage cans upright on the rough and bumpy ground in the tent with high chances of them being overturned on the ground, thereby soiling the tent or clothes and creating discomfort while camping. So, cups and drink cans have to be supported in some way or people have to continuously hold them in order to prevent them from spilling in the existing tents.

SUMMARY OF THE INVENTION

It is, therefore, an object of the present invention to provide a foldable board for keeping some small personal belongings and an opened beverage can conveniently and safely.

In accordance with an embodiment of the present invention, there is provided a foldable board for arranging small articles in a tent, comprising a first part provided with a first fixing portion for fixing the first part to the tent; a second part provided with a second fixing portion for attaching the second part to the first part when the second part is folded; and a connecting part for maintaining the second part at a predetermined angle with respect to a bottom surface of the tent when the second fixing portion is detached from the first part.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE PREFERRED EMBODIMENTS

Figure 1:
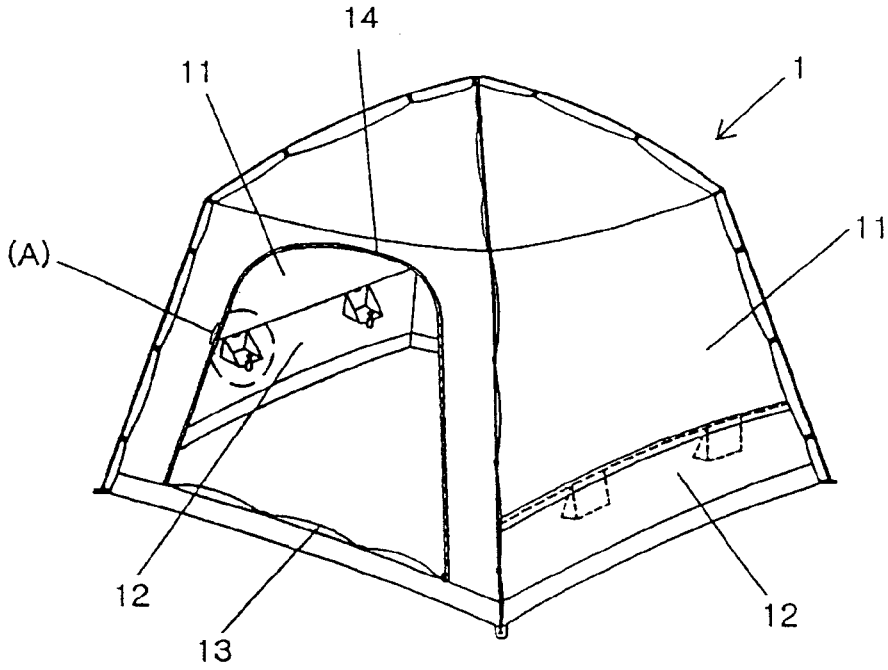
FIG. 1 is a perspective view depicting a preferred embodiment of present invention.
Figure 2:
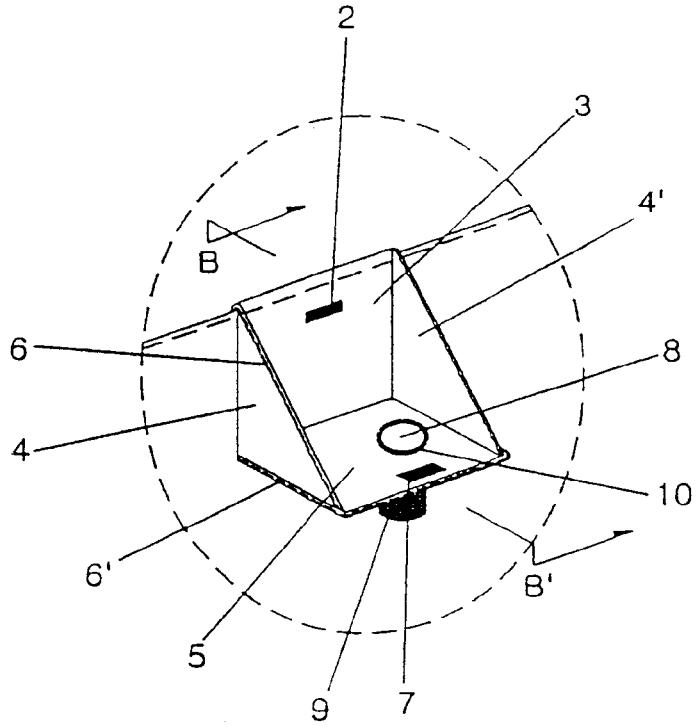
FIG. 2 represents a perspective view enlarging the part A of FIG. 1.
Figure 3:
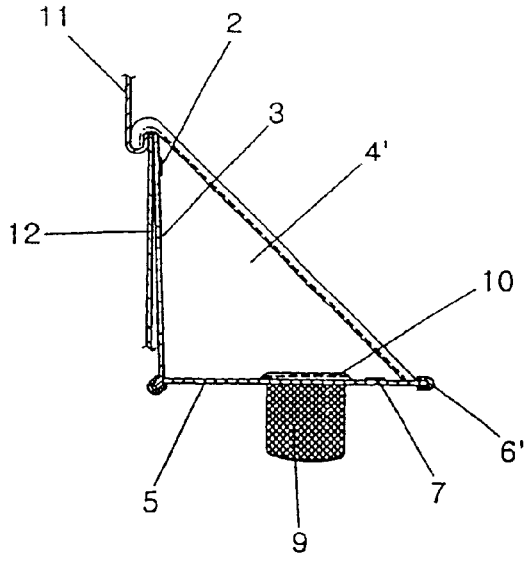
FIG. 3 depicts a cross-sectional view taken out from a line B to B' of FIG. 2.
Figure 4:
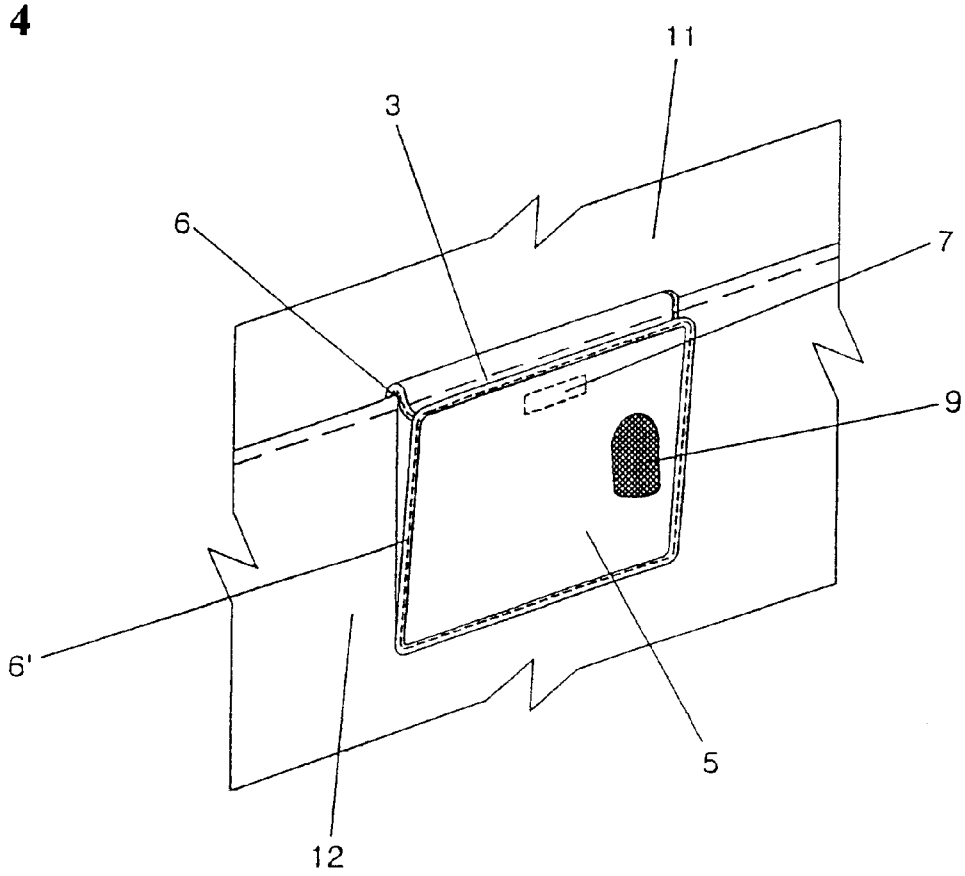
FIG. 4 is a front view of the foldable board of the present invention when folded onto the inside of a tent.
Figure 5:
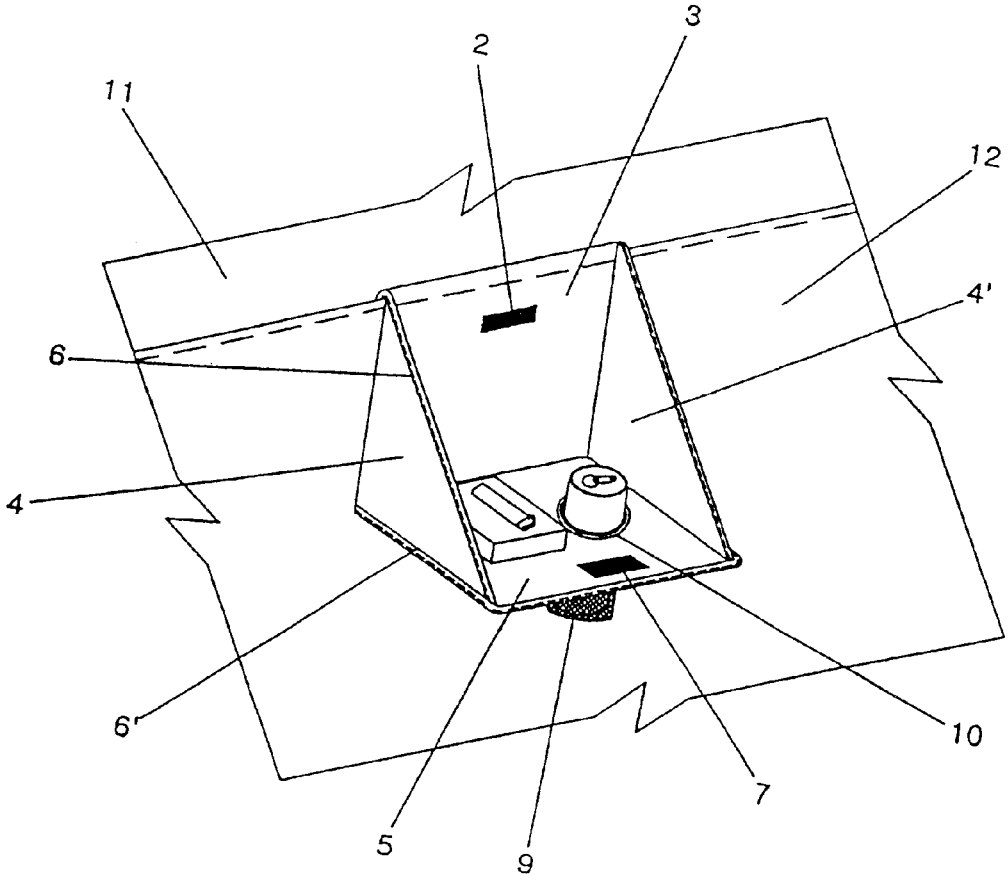
FIG. 5 shows an exemplary view illustrating an application of the foldable board in use, in accordance with the present invention.

As shown in FIG. 1, the present invention is designed to be installed in a tent 1 which, as shown, includes upper tent fabric 11, lower tent fabric 12, a tent bottom 13, and a tent opening 14. Once the tent has been set up, the present invention, shown in relation to the tent in FIG. 1 and in various views in FIGS. 2–5, may be used to secure a canned beverage as well as to keep small belongings such as a cigarette pack and a lighter (FIG. 5).

The foldable board of the present invention includes a laminated bottom prop 5, a back prop 3 and side props 4, 4'.

In a preferred embodiment, the bottom prop is made of polyvinyl choride (PVC), but other equivalent materials may also be used. The back prop 3 is attached by a first fixing portion to the inside of the tent. The first fixing portion may be sewn, glued, taped or otherwise connected to the tent. In a preferred embodiment, the back prop is inserted between the upper tent fabric 11 and the lower tent fabric 12 and sewn thereto.

The bottom prop 5 includes a hole 8 through which a cup or beverage can may be inserted. A mesh bag 9 is sewn on the circumference of the hole reinforcement portion 10 to close the bottom of the hole and retain the cup or beverage can. The remainder of the surface of the bottom prop 5 may be used for placing small belongings such as a cigarette pack and a lighter thereon. Also included on the upper surface of the bottom prop 5 is a second fixing portion 7 for attaching the bottom prop to the back prop 3 when the bottom prop is folded up. In a preferred embodiment, the second fixing portion 7 includes a hook and loop type fastener such as Velcro®, but other forms of fasteners may also be used. If hook and loop type fasteners are used, the back prop includes a complementary fastener 2 suitably located on the inner surface which faces the bottom prop when folded.

The side props 4, 4' are sewn to the back prop 3 along stitching 6 and are further sewn to the bottom prop 5 along stitching 6' with bias, thus supporting and maintaining the bottom prop 5 horizontally.

In use, the foldable board of the present invention is sewn to the inside of the tent as has been described. During storage of the tent, the bottom prop is folded against the back prop and secured thereto using the second fixing portion. Because the mesh bag is soft, the foldable board may be secured nearly flush with the side of the tent. Once the tent is up, the laminated bottom prop 5 is pulled down from the back prop 3. In a preferred embodiment, this pulling down is accomplished by separating complementary hook and loop straps located on each of the bottom and back props. Once the second fixing portion has been unfastened, the bottom prop extends horizontally and is held there by the side props 4, 4'. A drink can may then be placed in the hole 8 and kept from passing through the hole by the mesh bag 9. Other articles of suitable size may be placed on the remaining surface of the bottom prop 5.

When use of the foldable board is complete, the belongings and drink cans are removed and the bottom prop 5 is pushed upward toward the back prop 3, thereby folding the side props 4, 4', and the hook or loop fastener on the bottom prop is pressed against the corresponding loop or hook fastener on the back prop.

The present invention maximizes practicality and minimizes the inconvenience of camping life by providing, simply by pulling down the bottom prop 5 and separating the Velcro tapes, a secure and convenient place for an opened drink can or a cup. Such can may be placed in the hole provided with the mesh bag 9 and small belongings such as a cigarette pack and a lighter may be placed on the remaining space of the PVC bottom prop 5, which is maintained at a generally horizontal level by the side props 4,4'.

While the present invention has been described with respect to certain preferred embodiments, it will be apparent to those skilled in the art that various changes and modifications may be made without departing from the scope of the invention as defined in the following claims.

What is claimed is:

1. A foldable board in combination with a tent for arranging small articles in a tent, comprising:

a first part permanently affixed to the tent;

a second part foldably connected to said first part and provided with a fixing portion for attaching the second part to the first part when the second part is folded; and a connecting part permanently affixed to said first part and to said second part for maintaining the second part at a predetermined angle with respect to a bottom surface of the tent when the fixing portion is detached from the first part.

2. The foldable board of claim 1, wherein the second part includes a hole and a mesh bag for holding an article.

3. The foldable board of claim 2, wherein the second part further includes a hole reinforcement portion.

4. The foldable board of claim 3, wherein the mesh bag is sewn in the hole reinforcement portion.

5. The foldable board of claim 1, wherein the second part is made of polyvinyl chloride (PVC).

6. The foldable board of claim 1, wherein the fixing portion includes tape.

7. The foldable board of claim 1, wherein the second part is sewn to the connecting part.

8. The foldable board of claim 1, wherein said first part is sewn on a connecting portion of the tent.

9. The foldable board of claim 1, wherein the fixing portion includes a fabric closure of hooks and loops.

10. The foldable board of claim 9, said first part including a fabric closure of hooks and loops complementary to and interacting with said fixing portion for holding the second part against the first part when said board is not in use.

11. The foldable board of claim 2, wherein the article is a cup.

12. The combination of a tent and a foldable board for arranging small articles therein, said foldable board comprising:

a first part permanently affixed to and substantially parallel with a wall of said tent;

a second part foldably and permanently connected along one side to said first part and provided with a fixing portion for attaching the second part to the first part when the second part is folded upwardly to be substantially parallel with said first part; and a connecting part permanently affixed along a first side to said first part and along a second side to said second part for maintaining the second part at a predetermined angle with respect to a bottom surface of the tent when the fixing portion is detached from said first part.

13. The foldable board of claim 12, wherein said connecting part is sewn along said first and second sides to said first part and said second part, respectively.

14. The foldable board of claim 13, wherein said connecting part is a generally triangular piece of fabric.

15. The foldable board of claim 12, wherein the second part further includes a hole reinforcement portion with a mesh bag sewn therein.

16. The foldable board of claim 12, further comprising a pair of connecting parts, each connecting part being a generally triangular piece of fabric sewn to a respective side of said first part and to a respective side of said second part.

17. The foldable board of claim 16, wherein the second part further includes a hole reinforcement portion with a mesh bag sewn therein, said mesh bag collapsing and said pair of connecting parts folding when said second part is folded upwardly against said first part and fastened thereto by said fixing portion such that said first and second parts are substantially flush with said tent wall as folded.

* * * * *